US011357331B1

(12) United States Patent
Lake

(10) Patent No.: US 11,357,331 B1
(45) Date of Patent: Jun. 14, 2022

(54) ADJUSTABLE ANGLE CHAIR SEAT

(71) Applicant: Eustace Roger Lake, Treasure Island, FL (US)

(72) Inventor: Eustace Roger Lake, Treasure Island, FL (US)

( * ) Notice: Subject to any disclaimer, the term of this patent is extended or adjusted under 35 U.S.C. 154(b) by 0 days.

(21) Appl. No.: 17/300,014

(22) Filed: Feb. 8, 2021

(51) Int. Cl.
*A47C 1/00* (2006.01)
*A61G 5/14* (2006.01)
*A47C 7/58* (2006.01)
*A47C 7/18* (2006.01)

(52) U.S. Cl.
CPC ..... *A47C 7/58* (2013.01); *A47C 7/185* (2013.01); *A61G 5/14* (2013.01)

(58) Field of Classification Search
CPC ..... A47C 7/185; A47C 7/58; A61G 5/14
USPC ..... 297/284.11, DIG. 10
See application file for complete search history.

(56) References Cited

U.S. PATENT DOCUMENTS 3,479,086 A * 11/1969 Sheridan ..... A61G 5/14 297/DIG. 10
3,479,087 A * 11/1969 Burke ..... A61G 7/1007 297/DIG. 10 X
4,249,774 A * 2/1981 Andreasson ..... A61G 5/14 297/DIG. 10 X
4,453,766 A * 6/1984 DiVito ..... A61G 5/14 297/DIG. 10
4,637,654 A * 1/1987 Boardman ..... A61G 5/14 297/DIG. 10
4,690,457 A * 9/1987 Poncy ..... A61G 5/14 297/DIG. 10
4,838,612 A * 6/1989 Cross ..... A61G 5/14 297/DIG. 10
4,884,841 A * 12/1989 Holley ..... A61G 7/1094 297/DIG. 10 X
4,979,726 A * 12/1990 Geraci ..... A61G 5/14 297/DIG. 10
5,011,224 A * 4/1991 Paul ..... A61G 5/14 297/DIG. 10
5,316,370 A * 5/1994 Newman ..... A61G 5/14 297/DIG. 10
5,333,931 A * 8/1994 Weddendorf ..... A61G 5/14 297/DIG. 10
5,716,099 A * 2/1998 McDiarmid ..... A47C 7/14 297/284.11 X
6,106,063 A * 8/2000 Dauphin ..... A47C 1/023 297/284.11 X
8,201,890 B1 * 6/2012 Nagoaka Mihara ..... A61G 5/14 297/423.11
8,398,171 B2 * 3/2013 Lin ..... A61G 5/14 297/DIG. 10
10,758,439 B1 * 9/2020 Lake ..... A47C 7/02
2005/0264070 A1 * 12/2005 Kao ..... A61G 5/14 297/284.11
2009/0188028 A1 * 7/2009 Jiang ..... A61G 5/14 4/239
2009/0250979 A1 * 10/2009 Kooistra ..... A61G 5/14 297/115

(Continued)

*Primary Examiner* — Rodney B White

(57) ABSTRACT

Many persons that find it difficult to stand from a chair use powered lift chairs that lift the chair seat in an upward direction. These seats are generally one piece seats and offer only one departure angle that is not suitable for all persons. The adjustable angel chair seat allows the person to choose the best departure angle from the seat for the safest departure from the chair.

12 Claims, 5 Drawing Sheets

(56) References Cited

U.S. PATENT DOCUMENTS

| | | | | |
|---|---|---|---|---|
| 2011/0084529 | A1* | 4/2011 | Huang | A61G 5/14 297/330 |
| 2013/0175840 | A1* | 7/2013 | Nadav | A61G 5/14 297/313 |
| 2016/0310334 | A1* | 10/2016 | Bliem | A47C 3/22 |
| 2017/0258665 | A1* | 9/2017 | Maekawa | B62B 5/00 |
| 2018/0085266 | A1* | 3/2018 | Huang | A61G 5/14 |
| 2018/0271727 | A1* | 9/2018 | Lee | A61G 5/14 |
| 2019/0125601 | A1* | 5/2019 | Hector | A61G 5/1056 |
| 2020/0197246 | A1* | 6/2020 | Kim | A61G 5/14 |
| 2021/0030608 | A1* | 2/2021 | Brown | A61G 5/14 |

* cited by examiner

ADJUSTABLE ANGLE CHAIR SEAT

FIELD OF THE INVENTION

The invention is designed to help a person that has difficulty standing from a powered seat lift chair. It allows them to maintain more of a level setting position prior to exiting from the chair. The rear section of this seat is adjustable to different angles to allow for different angles in relation to the floor.

BACKGROUND

Power seat lift chairs that are on the market to assist people that have difficulty stand from a chairs. These types of chairs, such as commonly owned U.S. Pat. No. 10,758,439 B1, which is hereby incorporated by reference, have the whole seat that moves upward from the rear of the chair. The seat is generally attached to the front chair support which is mounted between the left chair leg and the right chair leg of the chair with a hinge or rotating device which maintains the front of the seat attached to the chair. As the seat is lifted from the rear it develops a steep angle in relation to the floor. For some persons, that angle may cause them to exit the chair sooner than they would like, resulting in a somewhat unstable standing position. The present invention solves that issue and provides options.

In the present environment of power lift seat chairs, there is a lack of power lift seat chairs with seats that allows for different seat exit positions. The present invention has the ability to adjust the rear section of the seat of a power lift seat chair allowing for different exit angles from the chair. This improvement allows the rear section to remain more level to the floor as the front section of the seat is raised, allowing the person to walk off the chair with the aid of the arm rest.

The standard seat, such as the one in commonly owned U.S. Pat. No. 10,758,439 B1, needs to be removed by disconnection the power lift device from the seat bottom. Lift the back of the seat up and remove it from the front rotating device. The adjustable angle chair seat of the present invention then needs to be attached to an attachment device that pivotally attaches the front section of the seat to a front chair support and a power lifting device attached to the bottom surface of the front section of the adjustable angle chair seat.

SUMMARY

The present invention is designed to help the person using a powered seat lift chair to aid them in standing from the chair. Having a two-piece seat allows different sitting angles, allowing them a choice of the position of the seat which gives them the best sitting and exiting position that best suits their needs.

DETAILED DESCRIPTION OF THE INVENTION

The following FIGS. 1-4 will point out the main features of this invention but do not limit the exact location of these features herein.

Figure 1:
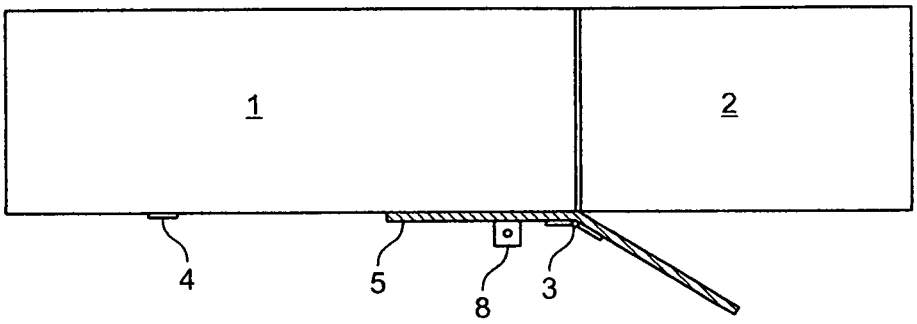
FIG. 1 is a side view of the adjustable angle chair seat in the initial position.
Figure 2:
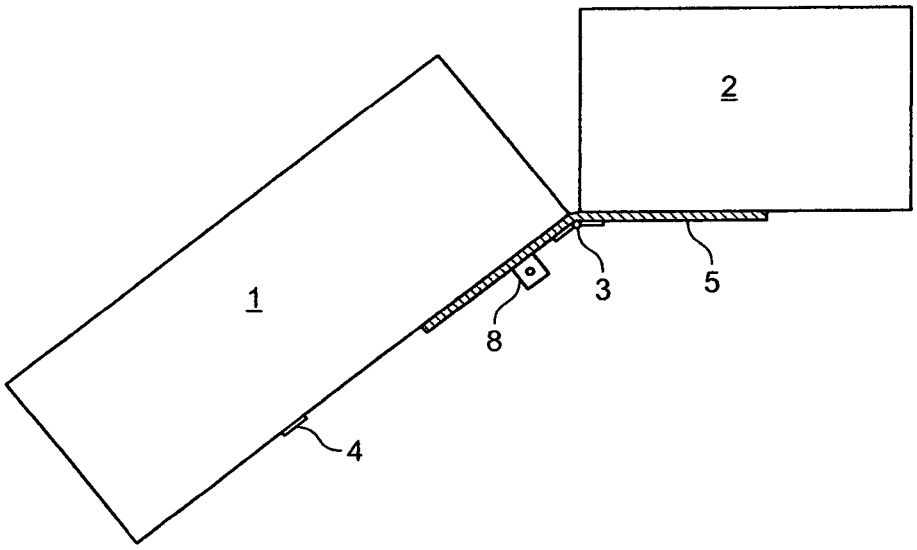
FIG. 2 is a side view of the adjustable angle chair seat with the front section of the adjustable angle chair seat adjusted to angle position with respect to the rear section of the adjustable angle chair seat.

FIGS. 1-2 illustrate a the present invention of the adjustable angle chair seat having a front section (1) and a rear section (2) having a bottom made of ¾" plywood or other type strong material. A foam padding or any other type of seat padding, covered with fabric or any other type of covering may be provided to attach the padding to the front and rear sections of the adjustable angle chair seat.

Figure 5:
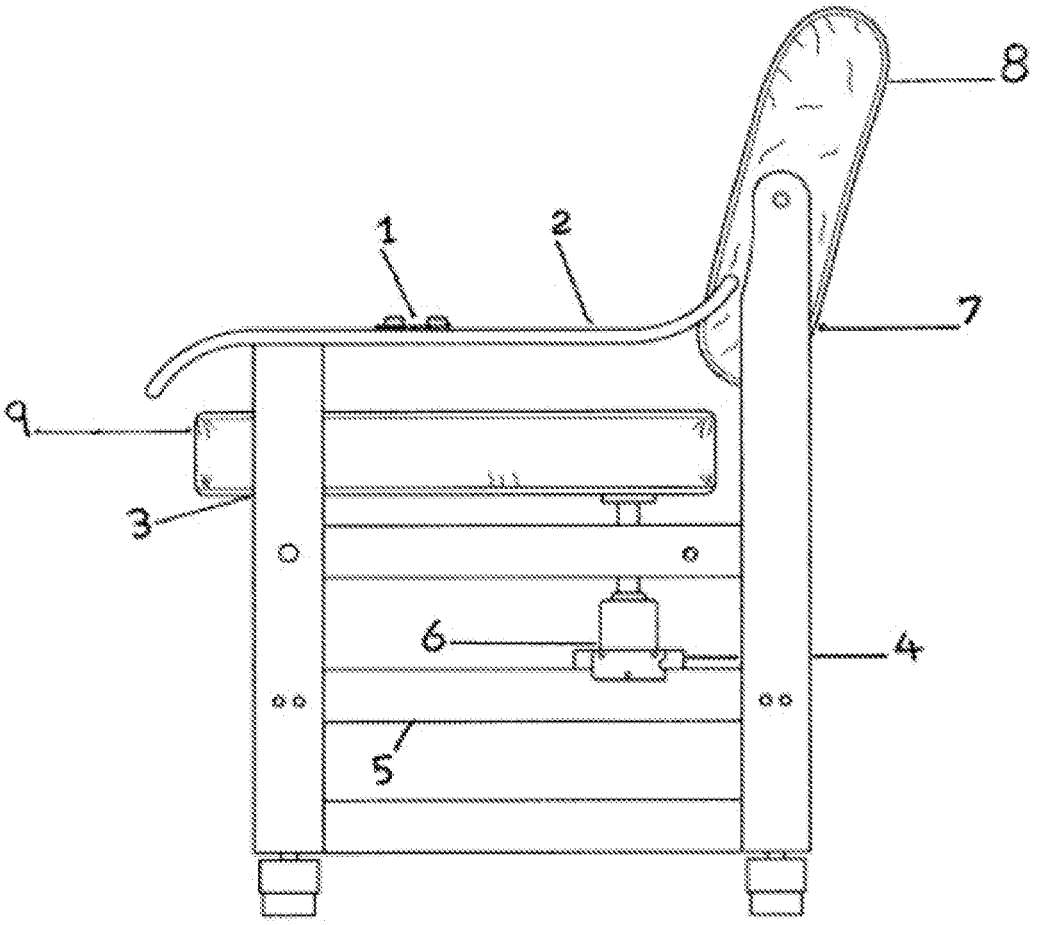
FIG. 5 (PRIOR ART)
FIGS. 5-6 show a conventional power lift chair with a single one-piece seat that moves upward from the rear of the chair. The seat is generally attached to the front chair support which is mounted between the left chair leg and the right chair leg of the chair with a hinge or rotating device which maintains the front of the seat attached to the chair.
Figure 6:
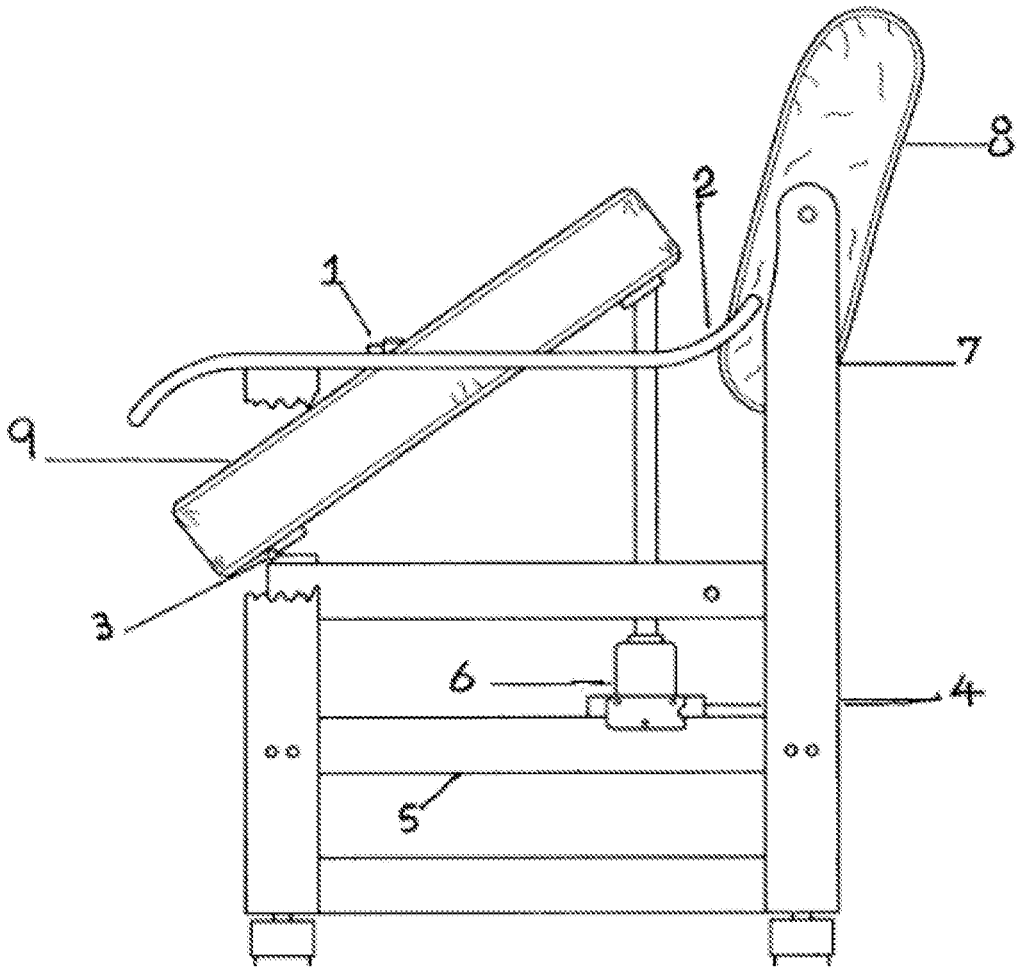
FIG. 6 (PRIOR ART)

A hinge (3) connects front section (1) and rear section (2) together. An attachment device (4) that attaches front seat section (1) to the top of a chair seat brace that is attached to the right front chair leg and the left front chair leg in a position designed to support the seat like that of commonly owned U.S. Pat. No. 10,758,439 B1, as shown in FIGS. 5-6. Steel support bars 5 designed with the desired angle to support rear seat section (2) when it is in the process of being lifted in a vertical position.

Steel support flat bars 6 are designed to lock front seat section (1) and rear seat section (2) together forming a solid horizontal plain, and moveable to allow the front seat section (1) and the rear seat section (2) to obtain a desired angle using the hinge (3).

Brackets (7) guide the movement of flat bars (6) forward and backward to lock the front seat section (1) and the rear seat section (2) into the desired position. Each guide has a set screw to lock the flat bars (6) into the desired positions. An attachment bracket (8) is attached to the bottom of the front seat section (1) for attachment to the lifting device.

The adjustable angle chair seat has two sections, a front section (1) and a rear section (2). The front section consists of approximately ⅔ of the seat area and the rear section is approximately ⅓ of the seat area from front to back. The seat has an approximate length of 18" from the front of the seat to the back of the seat and a width of 19½". The front section is pivotally connected to the back section with a hinge (3).

The seat obtains different angles as it is raised from the chair platform. This is accomplished with two bars (5) made of a strong material that have predetermined angles built into the bars. They are attached one on each side of the seat of the front seat section, one on the right side of the seat and one on the left side of the seat extending from front to back. The rear most part of the bar is located approximately 2" under the rear section of the seat. When bar (6) is locked on front seat section (1) and the seat is raised with the power lift device, the back section will not move up until the angle portion of the bar (5) contacts the rear seat section. That angle is approximately 2" lower than the portion attached to the front seat section which now places the rear seat section at a more level position to the floor, allowing a flatter and more stable platform for the person to sit on as the seat is being lifted upward. The result being that the person, with the help of the arm rest, can walk out of the chair.

Figure 3:
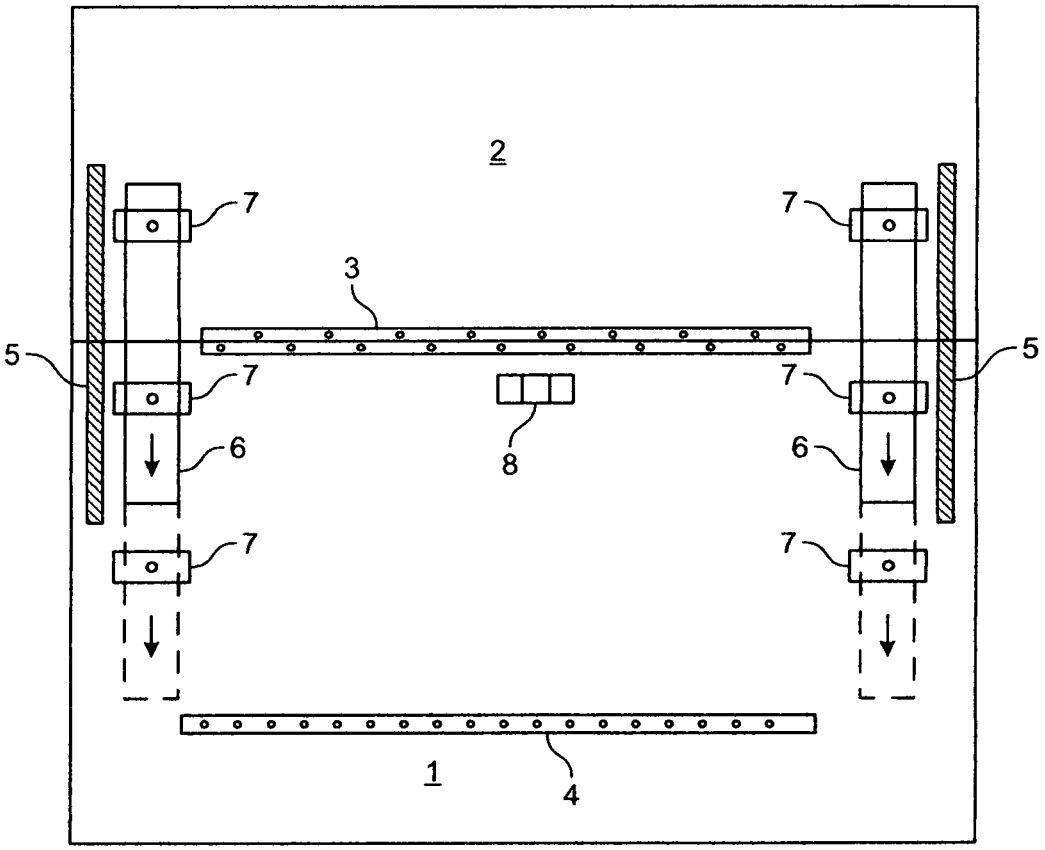
FIG. 3 is a bottom view of the adjustable angle chair seat of FIG. 1.
Figure 4:
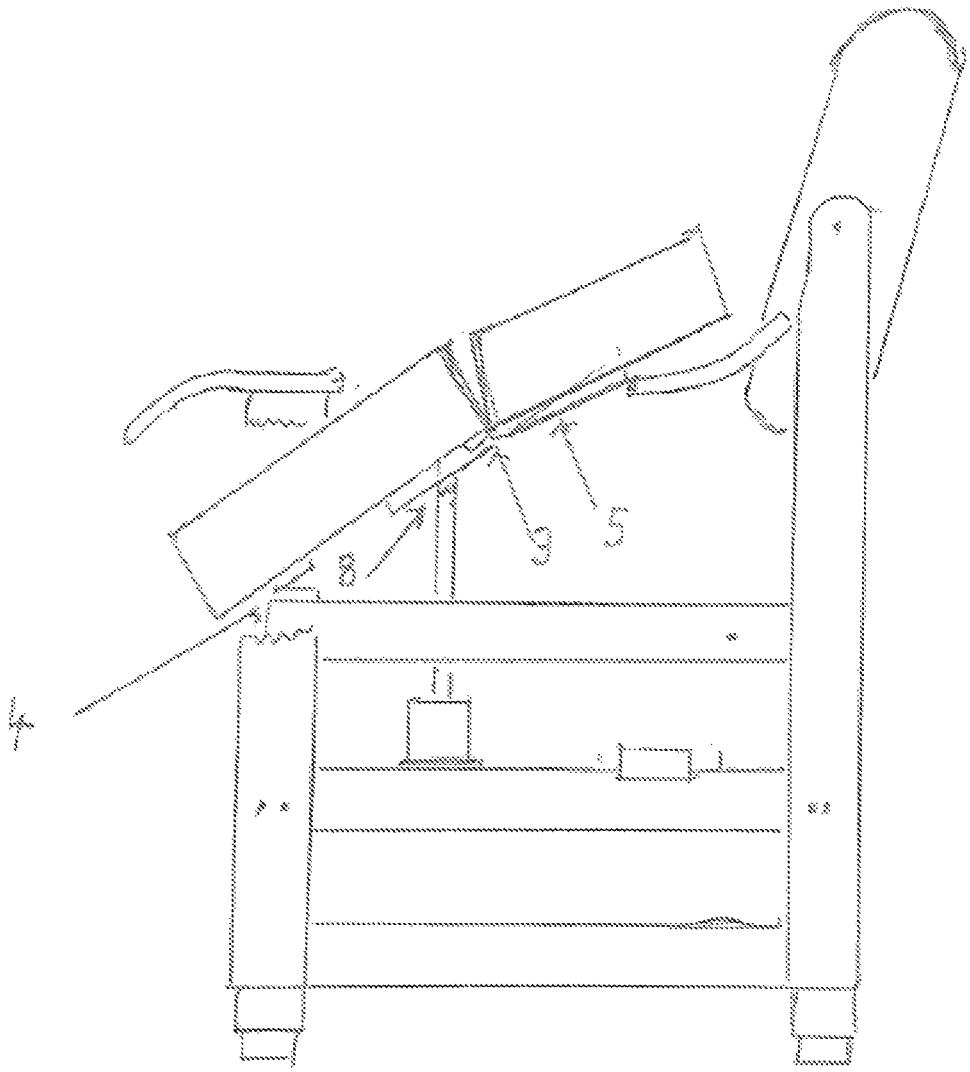
FIG. 4 depicts the adjustable angle chair seat in a standing position.

Another feature of the adjustable angle chair seat is being able to lock the front and rear sections together making it a one-piece seat for those that prefer that type of departure from the chair. Two flat strong bars (6) are attached to each side of the seat bottom as shown in FIG. 3. They are attached to the seat by brackets (7) with set screws attached to the top of the bracket (7). The brackets (7) are used to guide the bars (6 and lock the bars (6) in place with the set screws when it is desired to lock the bars (6) into positions. One bracket will be mounted on the rear section of the seat on each side and two brackets will be mounted on the front section on each side of the seat running front to back. The brackets allow the bars (6) to move forward and backward depending on the position desired. The bars (6) can then be locked with the set screws to lock the desired positions in place. When in the forward position of the bars (6) are in all three brackets, the chair is locked into a one-piece ea. When bars (6) are locked all the way on the front section the front seat section is allowed to pivot.

The invention claimed is:

1. A seat configured for attachment to an electric power seat lift chair comprising:

a seat having a front seat section and a rear seat section located behind the front seat section;

the front section having a top surface, a bottom surface, a front surface, and a rear surface;

the rear section having a top surface, a bottom surface, a front surface, and a rear surface;

a hinge mechanism pivotally connecting the front seat section to the rear seat section; the hinge mechanism for allowing pivotal movement of the front seat section with respect to the rear seat section to allow angular adjustment of the front seat section with respect to the rear seat section;

a first bar and a second bar attached to the bottom surface of the front section of the front seat section, each of the first and second bars having a first horizontal portion and a second horizontal portion fixedly joined to the first horizontal portion at a predetermined angle; the first horizontal portion attached to a bottom surface of the front seat section with the second horizontal portion extending downwardly at the predetermined angle under the bottom surface of the rear section;

the seat movable between a first initial position, where the front seat section and the rear seat are aligned with the rear surface of the front seat section abutting the front surface of the rear seat section to form a single continuous seating surface with the second bar extending at the predetermined angle under the bottom surface of the rear seat section, and a range of adjusted positions where the front seat section is pivoted to one of a plurality of angular positions with respect to the rear seat section, a first attachment device attached to the bottom surface of the front seat section of the seat and configured to be pivotally attached to a frame of a chair, a second attachment device attached to the bottom surface of the front seat section at a distance behind the first attachment device, the second attachment device configured for attachment to an end of a power lifting device; and wherein the power lifting device is configured to pivot the front seat section until the second horizontal portion of each of the first and second bars abuts the bottom surface of the rear seat section and further raises the rear seat section to aid a person sitting in the chair in standing from the chair.

2. The seat according to claim 1, wherein the front seat section and the rear seat section are made of a strong material.

3. The seat according to claim 2, wherein the strong material is plywood.

4. The seat according to claim 1, wherein a padding covers the front seat section and the rear seat section.

5. The seat according to claim 4, wherein the padding is a foam material.

6. The seat according to claim 4, wherein the padding has a fabric covering attaching the padding to the front seat section and the rear seat section.

7. A seat configured for attachment to an electric power seat lift chair comprising:

a seat having a front seat section and a rear seat section located behind the front seat section;

the front section having a top surface, a bottom surface, a front surface, and a rear surface;

the rear section having a top surface, a bottom surface, a front surface, and a rear surface;

a hinge mechanism pivotally connecting the front seat section to the rear seat section; the hinge mechanism for allowing pivotal movement of the front seat section with respect to the rear seat section to allow angular adjustment of the front seat section with respect to the rear seat section;

a first bar and a second bar attached to the bottom surface of the front section of the front seat section, each of the first and second bars having a first horizontal portion and a second horizontal portion fixedly joined to the first horizontal portion at a predetermined angle; the first horizontal portion attached to a bottom surface of the front seat section with the second horizontal portion extending downwardly at the predetermined angle under the bottom surface of the rear section;

the seat movable between a first initial position, where the front seat section and the rear seat are aligned with the rear surface of the front seat section abutting the front surface of the rear seat section to form a single continuous seating surface with the second bar extending at the predetermined angle under the bottom surface of the rear seat section, and a range of adjusted positions where the front seat section is pivoted to one of a plurality of angular positions with respect to the rear seat section, two pairs of brackets attached to the bottom surfaces of the front seat section and the rear seat section of the seat, each pair of brackets having a first pair of brackets attached to left and right sides on the bottom surface of the rear seat section and a second pair of brackets attached to left and right sides of the bottom surface of the front seat section and aligned opposite the first pair of brackets on the rear seat section;

first and second flat bars slidable received in the brackets of the front and rear seat sections, the first flat bar slidably received in one bracket underneath the rear seat section and a corresponding oppositely aligned bracket on the front seat section and the second flat bar slidably received in the other bracket underneath the rear seat section and the other bracket on the front seat section, the first and second flat bars configured to be slidable to move to a first position where a first portion extends underneath the front seat section and a second portion of each flat bar extends underneath the rear seat section and locked in place to support the rear seat section and the front seat section and to prevent the front seat section from pivoting with respect to the rear seat section and maintain the front seat section and the rear seat section in the first initial position, wherein the front seat section and the rear seat section are aligned with the rear surface of the front seat section abutting the front surface of the rear seat section to form a single continuous seating surface position, to a second position in which the first and second flat bars are moved to a second position where the first portion of the flat bar is no longer underneath and supporting the front seat section and the flat bars are locked in place beneath the rear seat section to allow the front seat section to pivot with respect to the rear seat section;

a first attachment device attached to the bottom surface of the front seat section of the seat and configured to be pivotally attached to a frame of a chair, a second attachment device attached to the bottom surface of the front seat section at a distance behind the first attachment device, the second attachment device configured for attachment to an end of a power lifting device;

wherein when the first and second flat bars are in the first position, the power lifting device is configured to lift the front seat section and the rear seat section while the front seat section and the rear seat section are in the single continuous seating surface position to aid a person sitting in the chair in standing from the chair; and wherein when the first and second flat bars are moved to a second position, the power lifting device is configured to pivot the front seat section until the second horizontal portion of each of the first and second bars abuts the bottom surface of the rear seat section and further raises the rear seat section to aid a person sitting in the chair in standing from the chair.

8. The seat according to claim 7, wherein the front seat section and the rear seat section are made of a strong material.

9. The seat according to claim 8, wherein the strong material is plywood.

10. The seat according to claim 7, wherein a padding covers the front seat section and the rear seat section.

11. The seat according to claim 10, wherein the padding is a foam material.

12. The seat according to claim 10, wherein the padding has a fabric covering attaching the padding to the front seat section and the rear seat section.

* * * * *